United States Patent [19]

Reichman

[11] 4,189,198

[45] Feb. 19, 1980

[54] CONDUIT GROUND WIRE COUPLING

[75] Inventor: Eli Reichman, Flushing, N.Y.

[73] Assignee: Gould Inc., East Farmingdale, N.Y.

[21] Appl. No.: 929,336

[22] Filed: Jul. 31, 1978

[51] Int. Cl.[2] ..... H01R 15/00

[52] U.S. Cl. ..... 339/13; 339/14 L; 339/245

[58] Field of Search ..... 339/13, 14, 61 R, 65, 339/201, 245, 251

[56] References Cited

U.S. PATENT DOCUMENTS

| | | | |
|---|---|---|---|
| 1,793,911 | 2/1931 | Dann | 339/245 |
| 3,066,277 | 11/1962 | Edmunds | 339/245 |
| 3,365,693 | 1/1968 | Browne | 339/14 L |

*Primary Examiner*—Roy Lake
*Assistant Examiner*—DeWalden W. Jones
*Attorney, Agent, or Firm*—Howard C. Miskin

[57] ABSTRACT

A conduit grounding wire coupling device includes an insulator bushing carrying internally threaded collar for engaging an externally threaded section of an electrical conduit, the collar being provided on its outer peripheral face with circumferentially spaced, radial protuberances having flat outer faces with tapped central bores and angularly spaced diametric grooves in each outer face radiating from respective tapped bores. A wire clamp member includes a rear wall and longitudinally spaced outwardly projecting arms, one of which defines a first jaw and the other having a tapped bore engaging a second jaw carrying bolt. The clamp member rear wall has a depending section provided with a bore and a diametric ridge which engages a selected diametric groove and is locked to the collar at the selected orientation by a bolt engaging the collar and clamp member rear wall bores.

10 Claims, 5 Drawing Figures

CONDUIT GROUND WIRE COUPLING

BACKGROUND OF THE INVENTION

The present invention relates generally to improvements in electrical coupling devices and it relates more particularly to an improved wire coupling device for the grounding of a conductor housing metal conduit.

In conventional electrical distribution systems in dwellings and in commercial and industrial buildings, it is a common practice to enclose the electrical power lines in metal conduit which is for many reasons, generally grounded. The grounding of the electrical conduits is usually effected by connecting a grounded, heavy cable to the various conduits of the installation. By reason of the heavy current which must frequently be transferred to the grounding cable due to surges and other circumstances it is necessary that reliable and low resistance electrical coupling be effected between the grounding cable and the associated electrical conduits. To this end numerous conduit grounding cable coupling devices have been employed and proposed but these have heretofore possessed numerous drawbacks. A conduit grounding wire coupling device which is highly satisfactory up to a point is disclosed in U.S. Pat. No. 3,967,872 granted July 6, 1976 to T. Mooney and R. A. Bauer. However, while the aforesaid patented coupling device is adjustable to interconnect differently oriented conduit and grounding cable, it possesses an important disadvantage. Should there be any deviation in the orientation of the grounding cable or conduit or should there be any angular stress or torque between the grounding cable and the conduit there could result a loosening of the coupling device with the consequent increase in the electrical resistance thereof, particularly in the causing and presence of corrosion at coupling interfaces. Accordingly, the conduit grounding wire coupling devices heretofore available or proposed leave much to be desired.

SUMMARY OF THE INVENTION

It is a principal object of the present invention to provide an improved electrical coupling device.

Another object of the present invention is to provide an improved electrical conduit grounding device.

Still another object of the present invention is to provide an improved coupling device for electrically interconnecting a conductor housing metal conduit and a grounding cable or wire.

A further object of the present invention is to provide an improved stress resistant coupling device for interconnecting an electrical conduit and a grounding wire which is adjustable to accommodate conduit and grounding wire at various angular relationships.

Still a further object of the present invention is to provide a device of the above nature characterized by its ruggedness, reliability, low resistance, simplicity, ease of operation and application and great versatility and adaptability.

The above and other objects of the present invention will become apparent from a reading of the following description taken in conjunction with the accompanying drawings.

In a sense the present invention contemplates the provision of an improved conduit cable coupling device comprising a metal collar member having a first coupling face on the outer periphery of said collar, a threaded first bore extending through said first face, and a wire clamp member having a second coupling face in superimposed engagement with said first face and a bore extending through said second face and coaxial with said first bore; one of the faces having a plurality of recesses, circumferentially spaced about said bores and the other of said faces having a projection thereon releasably engaging a selected recess whereby to interlock the clamp member and the collar against relative rotation in a predetermined angular position with the projection engaging a preselected recess and a bolt engaging the first and second bores to lock the clamp member and collar in the predetermined angular position with the first and second faces in tight engagement.

According to a preferred form of the improved coupling device, the collar carries a plastic insulator bushing and has a plurality of circumferentially spaced radial protuberances on its peripheral surface with flat rectangular outer first faces. Each of the first faces has a threaded central first bore and regularly angularly spaced diametric grooves radiating from the first bore. The wire clamp member includes a C-shaped integral body member having a rear wall with a depending tab and a pair of upper and lower outwardly projecting arms, the lower arm being curved and defining a bottom jaw and the upper arm having a tapped bore engaging a threaded shank carrying an upper jaw confronting the lower jaw and defining a clamp therewith which is adjusted by turning the threaded shank. The depending tab has a flat rear second face engaging the first face and a second bore coaxial with the first bore and a horizontal diametric ridge releasably mating a selected diametric groove, the assembly being locked in position by a bolt engaging the first and second bore.

The improved coupling device wire clamp is thus angularly and circumferentially adjustable on the collar and is resistant to high torque and is of low electrical resistance, rugged and reliable and of great versatility and adaptability.

DESCRIPTION OF THE PREFERRED EMBODIMENT

Figure 1:
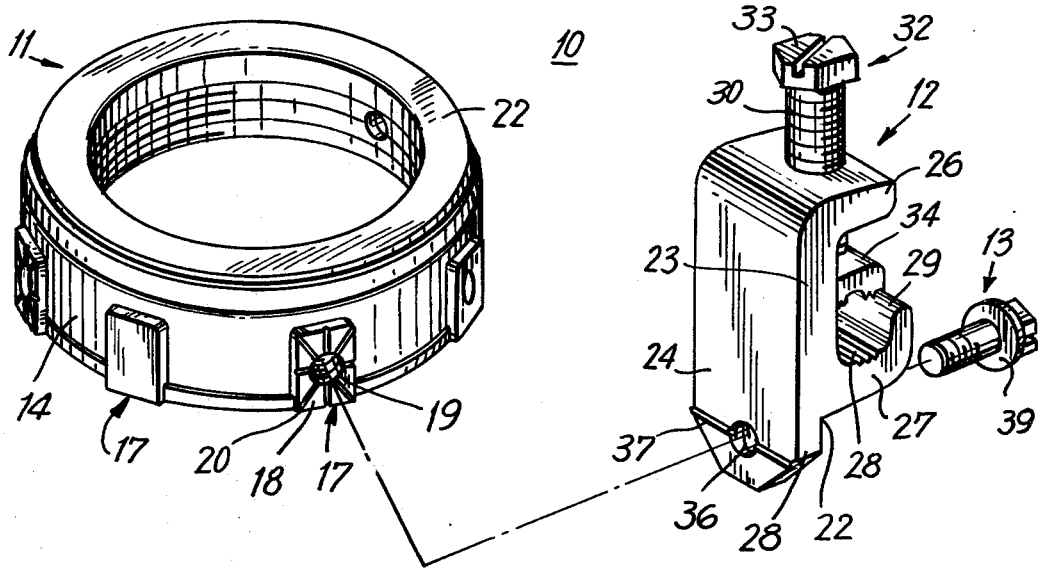
FIG. 1 is an exploded perspective view of a conduit grounding wire coupling device embodying the present invention.
Figure 2:
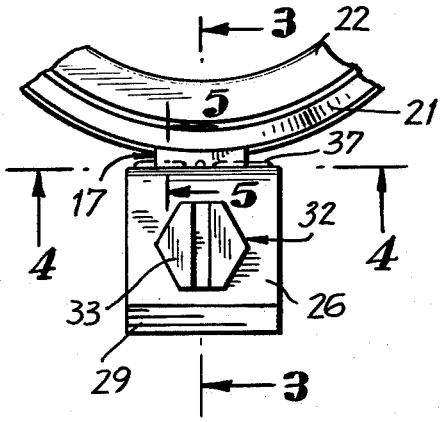
FIG. 2 is a fragmentary top plan view of the assembled coupling device.
Figure 3:
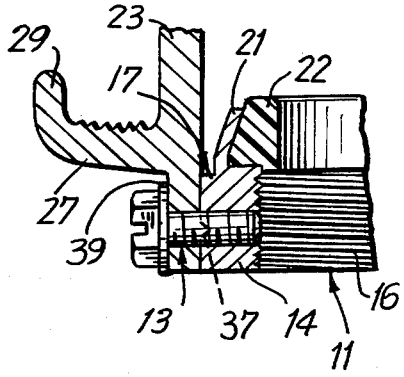
FIG. 3 is a fragmentary sectional view taken along line 3—3 in FIG. 2.
Figure 4:
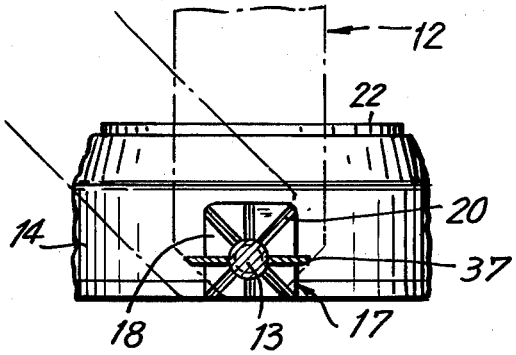
FIG. 4 is a sectional view taken along line 4—4 in FIG. 2, the clamp member being shown by broken line in different angular positions.
Figure 5:
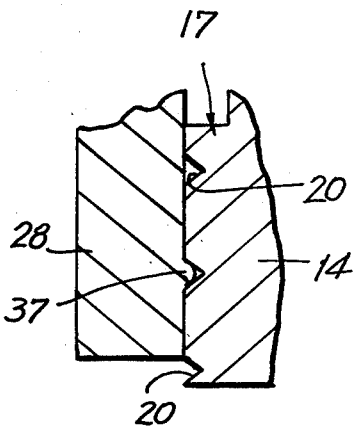
FIG. 5 is an enlarged sectional view taken along line 5—5 in FIG. 2.

Referring now to the drawings which illustrate a preferred embodiment of the present invention, the reference numeral 10 generally designates the improved conduit grounding wire coupling device which includes a conduit coupling collar 11, a cable or wire clamp member 12 and a coupling collar clamp member assembly locking screw 13. One or more of coupling devices 10 are employed with a corresponding number of conductor enclosing metal electrical conduits of known construction which are associated and related in any conventional manner as explained in the above identified U.S. Pat. No. 3,967,872.

The collar member 11 includes a metal cylindrical ring shaped body member 14 having a threaded inside face 16 and being provided on its outer peripheral surface with a plurality, preferably eight, regularly circumferentially spaced radially projecting shallow rectangular protuberances or projections 17 having flat outer faces 18 parallel to planes tangent to the outer face of body member 14. One or more, preferably alternate, protuberances 17 have central threaded radial bores 19 formed therein and have formed in their outer faces 18 a plurality of grooves 20 of triangular transverse cross section extending diametrically of the respective bores 19. Although each of the grooved faces is shown as having four diametric grooves, two diagonal, one horizontal and one vertical, more angularly related grooves may be provided. It should be noted that the bores 19 function to couple a clamp member 12 to collar 11 and may also function to receive a set screw, not shown, for locking the collar against rotation on the threaded section of an electrical conduit to which the collar is screw coupled.

Integrally formed with body member 14 adjacent its outer border is an axially inwardly inclined annular flange 21. An insulator bushing member 22 formed of a synthetic organic polymeric resin is entrapped in the space delineated by annular flange 21 and the adjacent end face of body member 14 and has an inner peripheral face located inwardly of the collar threaded face 16, preferably by at least the wall thickness of the associated electrical conduit and an outer end located beyond the outer end of flange 21.

The clamp member 12 is likewise formed of metal and comprises a body member 22 including a longitudinally extending rear wall having a flat planar outer face 24 and outwardly projecting upper and lower transverse arms 26 and 27 respectively, upper arm 26 being along the top of rear wall 23 and of the same width thereof and lower arm 27 being above the bottom of rear wall 23 and likewise being of the same width thereof. The section of rear wall 23 below lower arm 27 defines a tab section, the sides of the lower half of which converge downwardly. The upper face of arm 27 is laterally serrated or ribbed as at 28 and the arm 27 terminates at its outer end in a curved upwardly directed lip 29.

A threaded vertical bore is centrally formed in upper arm 26 and engages the threaded shank 30 of a clamp adjusting screw 32 having a slotted hex head 33. A laterally extending horizontal upper jaw member 34 is coupled to the lower end of threaded shaft 30 which is rotatable relative thereto and has a rear edge slidably engaging the vertical front face of rear wall 23 to prevent rotation of jaw member 34 so that rotation of screw 32 in one or the other direction lowers or raises upper jaw member 34 relative to the lower jaw member defining lipped arm 27 to close or open the clamp member 12 respectively. The underface of jaw member 34 is laterally cylindrically recessed and serrated or ridged.

A smooth bore 36 is centrally formed in rear wall tab section 28 and a horizontal ridge 37 is formed on the rear face of tab section 28 and extends medially across the full width of tab section diametric relative to bore 36. The ridge 37 is complementary in cross section to that of grooves 20 and has a rounded apex.

In the assembled condition of the coupling device 10 the rear face of tab section 28 is superimposed on a face 18 of a grooved protuberance 17 with the ridge 37 engaging a selected groove 20 depending on the desired orientation of clamp member 12 and the bores 19 and 36 being in coaxial alignment. Bolt 13 carrying a washer 39 engages aligned bores 19 and 36 and is tightened to releasably rigidly lock the coupling collar 11 and clamp member 12 in the preselected or desired angular relationship, the inter-engaged ridge and groove preventing relative angular movement between coupling collar 11 and clamp member 12 even under high torque conditions.

The angular relationship between coupling collar 11 and wire clamp member 12 may be adjusted merely by loosening bolt 13, turning clamp member 12 to bring ridge 37 into registry with a selected groove 20 and then tightening bolt 13. A cable or grounding wire, not shown, may be tightly engaged by clamp member 12 merely by turning screw 32 to raise upper jaw member 34 and open clamp member 12, bringing the grounding wire between the clamp jaw members and then turning screw 32 to lower upper jaw member 34 to tighten the clamp member 12 and tightly grip and retain the grounding wire and make a low resistance electrical contact therewith.

While bore 36 was illustrated as being smooth, advantageously it may be threaded and a portion of the threads on bolt 13 adjacent washer 39 are removed. This removal of the threads on bolt 13 retains bolt 13 affixed to the wire clamp member 12 and prevents inadvertent removal of the bolt. Also, the wire clamp member may be made of various metals such as aluminum, brass, copper or malleable iron or the like.

While there has been described and illustrated a preferred embodiment of the present invention it is apparent that numerous alterations, additions and omissions may be made without departing from the spirit thereof.

I claim:

1. A conduit cable coupling device comprising a coupling collar including a protuberance having a first coupling face and disposed on and projecting radially from the outer peripheral surface of said collar and having a threaded radial first bore projecting through said first coupling face, a cable clamp member including a clamp section provided with a clamp tightening screw member and having a second coupling face in superimposed engagement with said first coupling face and a second bore projecting through said second coupling face in coaxial alignment with said first bore, one of said coupling faces having a plurality of recesses forned therein circumferentially spaced about the respective bore in said face and the other of said coupling faces having a projection releasably engaging a preselected recess and a bolt engaging said first and second bores to interlock said collar and clamp members with said projection in engagement with said preselected recess.

2. The coupling device of claim 1 wherein said cable clamp member includes an arm extending longitudinally from said clamp section and said second bore is disposed in said arm and is longitudinally spaced from said clamp section.

3. The coupling device of claim 2 wherein said coupling faces are flat.

4. The coupling device of claim 3 wherein said recesses comprise linear grooves extending diametrically relative to said bores.

5. The coupling device of claim 4 wherein said projection comprises a linear ridge extending diametrically relative to said bores and along said preselected groove.

6. The coupling device of claim 5 wherein said grooves are formed on said first coupling face and said ridge is formed on said second coupling face.

7. The coupling device of claim 2 wherein said second bore of the cable clamp member is threaded and said bolt being threaded and having a head at one end, with no threads adjacent said head.

8. The coupling device of claim 1 including a plurality of said radially projecting protuberances regularly spaced along the periphery of said coupling member, a plurality of said protuberances having said first coupling faces with corresponding threaded bores.

9. The coupling device of claim 8 wherein said coupling collar is internally threaded.

10. The coupling device of claim 9 including a plastic insulator bushing secured to said coupling collar and coaxial therewith.

* * * * *